US006779447B2

(12) United States Patent
Frank et al.

(10) Patent No.: US 6,779,447 B2
(45) Date of Patent: Aug. 24, 2004

(54) DEVICE FOR REGISTERING THE POSITION OF A ROTOR PART IN A TRANSPORT SYSTEM

(75) Inventors: Hendrik Frank, Heidelberg (DE); Stefan Maier, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 203 days.

(21) Appl. No.: 10/045,138

(22) Filed: Jan. 14, 2002

(65) Prior Publication Data

US 2002/0101211 A1 Aug. 1, 2002

(30) Foreign Application Priority Data

Jan. 12, 2001 (DE) ..... 101 01 132

(51) Int. Cl.[7] ..... B41F 12/34

(52) U.S. Cl. ..... 101/232; 101/233; 101/183; 271/193; 318/38; 318/135

(58) Field of Search ..... 101/232, 233, 101/226–228, 181, 183, 483; 226/91–92; 271/193, 204; 310/12–14; 318/38, 135

(56) References Cited

U.S. PATENT DOCUMENTS

| | | | | |
|---|---|---|---|---|
| 4,096,384 A | | 6/1978 | Sartorio et al. | 250/237 |
| 5,047,676 A | | 9/1991 | Ichikawa | 310/12 |
| 5,130,583 A | * | 7/1992 | Andoh | 310/12 |
| 5,809,892 A | * | 9/1998 | Kruger et al. | 101/483 |
| 6,240,843 B1 | * | 6/2001 | Kruger et al. | 101/232 |
| 6,288,533 B1 | * | 9/2001 | Haeberli et al. | 324/207.2 |
| 6,532,791 B2 | * | 3/2003 | Schmid et al. | 73/1.79 |

FOREIGN PATENT DOCUMENTS

| | | |
|---|---|---|
| DE | 25 01 963 | 12/1975 |
| DE | 35 27 384 A1 | 4/1986 |
| DE | 35 40 568 A1 | 5/1987 |
| DE | 37 42 524 A1 | 3/1989 |
| DE | 29 07 175 C2 | 6/1989 |
| DE | 197 22 376 A1 | 12/1997 |
| DE | 197 48 802 A1 | 5/1998 |
| EP | 0 027 308 A1 | 4/1981 |
| JP | 61292502 A | 12/1986 |

* cited by examiner

*Primary Examiner*—Minh H Chau
(74) *Attorney, Agent, or Firm*—Laurence A. Greenberg; Werner H. Stemer; Gregory L. Mayback

(57) ABSTRACT

A device for registering the position of a rotor part in a transport system also having a static part in addition to the rotor part includes a dimensional standard forming part of the rotor part, and a plurality of transmitters provided on the static part; and a printing unit and a printing machine including the position registering device.

16 Claims, 6 Drawing Sheets

DEVICE FOR REGISTERING THE POSITION OF A ROTOR PART IN A TRANSPORT SYSTEM

BACKGROUND OF THE INVENTION

Field of the Invention

The invention relates to a device for registering the position of a rotor part in a transport system, in particular, for machines for processing printing material, which have a static or stationary part, such as a stator, in addition to the rotor part.

In printing-material processing machines, such as printing units, printing presses or the like, the transport of a printing material can be performed by a linear drive. A sheet transport system for transporting sheet material in a rotary printing machine is disclosed for example in the published German Patent Document DE 197 22 376 A1. This sheet transport system includes two mutually parallel extending guide rails, in each of which, respectively, an assigned forward drive element, forming the rotor part of an electric linear drive, is guided without play. The two forward drive elements are constructed as link chains having at least two individual links of magnetizable material, and are connected by a traverse or crossmember having grippers fixed thereto for holding the sheet. The drive of the forward drive elements is performed by drive stations with coils which are arranged outside the guide rails, form the stator of the linear drive and are arranged at distances from one another which are at least approximately equal to, i.e., are equal to or approximately equal to, the length of the forward drive devices.

In printing-material processing machines having at least one transport system, for example a linear drive, the rotor part or the rotor parts of the transport system are typically moved on a closed path in roundabout traffic. In order to move a drive under position control, permanent feedback of the measured position of the rotor part into a control system is absolutely required. For this reason, it is necessary to perform a registration of the position of the rotor part in the transport system.

The supplying of power to the transport system or the linear drive is typically ensured by using synchronous motors, the secondary part of which is moved, i.e., forms the rotor part. The static or stationary part includes the primary part, which is appropriately segmented in order to be able to drive a plurality of rotor parts on one track. In order to register the position of the rotor part, i.e., in order to obtain signals, diverse configurations of suitable transmitter devices for generating a signal by detection and suitable detection objects have already been proposed heretofore.

For example, a brushless linear drive supplied with direct current is disclosed in U.S. Pat. No. 5,049,676. The rotor part is driven electromagnetically forward and backward along a rail by at least one series of electromagnetic coils being activated sequentially. The position of the rotor part along the rail is determined by a transmitter that is fixed to the rotor part and detects the relative position in relation to a linear scale that is fixed to the base unit.

A drive module and a linear guide are disclosed in French Patent 92 12 321. They include a measuring system for the position of a rotor part, which has at least one transmitter on the rotor part, and a detection element on the static or stationary part of the drive module, so that the position of the rotor part can be determined. In a first embodiment, the measuring system can be an electromagnetic system including a magnetic measuring tape and a magnetic-field meter as transmitter, while, in a second embodiment, the measuring system may be an optical measuring system including an engraved straight edge or ruler that is illuminated by at least one light source, and a light-sensitive detector.

U.S. Pat. No. 4,096,384 describes a measuring transformer or transducer for picking up and measuring the relative deflection of a first part of a machine tool or a measuring machine in relation to a second part. At least two photoelectric pick-ups are accommodated on the first part, namely a rotor part, and at least two engraved straight edges or rulers are accommodated on the second part, namely a carrier element. The output signals from the photoelectric pick-ups are processed in a selection circuit, so that the relative deflection can be determined.

Furthermore, the Japanese Patent 61 292 502 describes a device for verifying the absolute position of a linear motor, which includes a primary winding and a secondary conductor, which lie opposite and at a given distance from one another, and are displaceable parallel to one another, the device being distinguished by the fact that the magnetic fields of the primary winding are laid out differently on a specified width, and a secondary conductor element is provided on a secondary conductor, the secondary conductor forming a body as a result of the addition of a plurality of verification heads, and the secondary conductor element forming a body as a result of the addition of a plurality of verification heads, in order to make it possible to verify the absolute position.

A disadvantage of mounting the transmitter or the transmitters on the rotor part is, for example, that either a permanent connection, for example, in the form of a cable dragger, or a telemetric connection, for example in the form of electromagnetic waves, between the rotor part and static or stationary part, for example, for a power supply, for a transmission of the position signal or the like, must be made to the control system. However, the use of cables to connect the moving transmitter to the control system necessitates an only limited travel distance or an only limited pivoting angle and is therefore unsuitable for the use of a rotor part on a closed path, such as is required, for example, for machines for processing printing material. In the case of a very long travel distance or in the case of many traverses of a closed path, the cable will be stressed to a great extent; furthermore, the mass of the cable which has to be dragged along is often too great. In the case of use in machines for processing printing material, in particular, sliding contacts must be dispensed with, for reasons of contamination and wear. Telemetric data transmission is very complicated when a plurality of rotor parts are used. In addition, a transmitter of electromagnetic waves on the rotor part has to be supplied with power, which makes necessary either a permanent connection for the supply of energy, or an additional mass of a power storage unit, which mass has to be moved. This is unacceptable for linear drives in printing machines. The use of a completely passive rotor part, i.e., a unit for which no power is needed to generate a position signal, is to be given preference.

A method of determining the position of an element that emits field lines in relation to sensors sensitive to field lines is described in the published German Patent Document DE 37 42 524 A1. The element that emits field lines is a position indicator, for example, a magnet which causes a voltage distribution that is typical of the position and which is used to determine the position of the position indicator, in the sensors which are sensitive to the field lines and are interrogated in multiplexed fashion. Each magnet position measured in length units corresponds to an unequivocally determined voltage distribution. Furthermore, the published German Patent Document DE 35 40 568 A1 discloses a device for the contactless determination of the position of magnets or other elements which emit field lines in accordance with the principle of position multiplexing of field-sensitive sensors.

A disadvantage in this case is that the position of only one dipole magnet or a few dipole magnets is determinable with only rather low accuracy. Moreover, complicated multiplex electronics are required in order to evaluate the signals from the sensors.

A further state of the prior art is represented by the published German Patent Document DE 35 37 384 A1, wherein a length-measuring device is disclosed which has a measuring carriage arranged to be displaceable with respect to a base bed and wherein a measuring spindle sleeve provided with a measuring rod and a first measuring head are arranged to be displaceable relative to one another, and which is distinguished by the fact that a second measuring head, which can be locked in position on the base bed, senses the measuring rod. The measuring range is expanded to virtually twice the length of the measuring rod, in that a sensing of the measuring rod when the measuring carriage is locked on the base bed is performed by the first measuring head or, when the measuring spindle sleeve is locked on the measuring carriage which is movable relative to the base bed, the sensing is performed by the second measuring head.

Furthermore, the published German Patent Document DE 29 07 175 C2 discloses a device for digitally indicating the relative displacement between an object and an object-related device, which has a magnetic scale with calibration signals of a predetermined wavelength and a first and a second magnetic head, which are arranged to reproduce the calibration signals of the magnetic scale during relative displacement and are energized in order to produce a first and a second balanced modulated signal, and also has an adder circuit to add the balanced modulated signals produced. Provision is made for an energizing circuit to energize the first and second magnetic heads with pulse signals to generate a balanced modulated pulse signal, a selection circuit to select a predetermined higher harmonic of the phase-modulated pulse signal and a detector for determining specific increments of a phase shift in the selected higher harmonic of the phase-modulated pulse signal.

It is accordingly an object of the invention to provided a device for registering the position of a rotor part in a transport system, in particular in a linear drive, which permits high precision of the position registration.

SUMMARY OF THE INVENTION

With the foregoing and other objects in view, there is provided, in accordance with one aspect of the invention, a device for registering the position of a rotor part in a transport system also having a static part in addition to the rotor part, comprising a dimensional standard forming part of the rotor part, and a plurality of transmitters provided on the static part.

In accordance with another feature of the invention, the plurality of transmitters are arranged along a position coordinate line of a position coordinate.

In accordance with a further feature of the invention, respective pairs of the plurality of transmitters arranged successively along the position coordinate line have at least approximately the same mutual spacing.

In accordance with an added feature of the invention, the spacing between two successive transmitters along the position coordinate line is at most equal to the length of the dimensional standard.

In accordance with an additional feature of the invention, the transmitters are magnetic field detectors, and the dimensional standard has a magnetic pattern.

In accordance with yet another feature of the invention, the transmitters are optical detectors, and the dimensional standard has a pattern for causing a variation in intensity of incident light.

In accordance with yet a further feature of the invention, at least one of the transmitters serves for generating an output signal, which, at least on an interval of the position coordinate, in an environment around the one transmitter, is a monotonic function of the position point of the dimensional standard.

In accordance with yet an added feature of the invention, the interval has a given length of the position coordinate of the dimensional standard for which, when the position point of the dimensional standard is in the interval, at least a first one of the transmitters serves for generating a first output signal, and at least a second one of the transmitters, which follows the first transmitter, serves for generating a second output signal.

In accordance with yet an additional feature of the invention, the first transmitter is surrounded by an environment wherein the first interval is located and from which the position point of the second transmitter is absent, and the second transmitter is surrounded by an environment wherein the first interval is located and from which the position point of the first transmitter is absent.

In accordance with still another feature of the invention, the position registering device includes a transmitter selected from the group thereof consisting of at least one reference pulse transmitter and at least one absolute transmitter.

In accordance with still a further feature of the invention, respectively, two reference pulse transmitters arranged along the position coordinate line have at least approximately the same mutual spacing.

In accordance with still an added feature of the invention, the spacing between two successive reference pulse transmitters, respectively, along the position coordinate line is at most equal to the spacing between two successive transmitters.

In accordance with still an additional feature of the invention, a first position point of the position coordinate of the dimensional standard coincides with a second position point of the position coordinate of the dimensional standard.

In accordance with another feature of the invention, two successive transmitters, respectively, a transmitter with a minimum index and a transmitter with a maximum index have at least approximately the same mutual spacing.

In accordance with a further feature of the invention, two successive reference transmitters, respectively, a reference transmitter with a minimum index and a reference transmitter with a maximum index have at least approximately the same mutual spacing.

In accordance with an added aspect of the invention, there is provided a printing unit having a device for registering the position of a rotor part in a transport system also having a static or stationary part in addition to the rotor part, comprising a dimensional standard forming part of the rotor part, and a plurality of transmitters provided on the static or stationary part.

In accordance with an additional aspect of the invention, there is provided a printing machine including a printing unit having a device for registering the position of a rotor part in a transport system which also has a static or stationary part in addition to the rotor part, comprising a dimensional standard forming part of the rotor part, and a plurality of transmitters provided on the static or stationary part.

In accordance with a concomitant feature of the invention, there is provided a printing machine comprising a feeder, at least one printing unit, a unit selected from the group consisting of a delivery unit and a post-processing unit, and at least one transport system having a device for registering the position of a rotor part in the transport system, the transport system also having a static or stationary part in addition to the rotor part, and including a dimensional standard forming part of the rotor part, and a plurality of transmitters provided on the static or stationary part.

The position registering device according to the invention for registering the position of a rotor part in a transport system, in particular for machines processing printing material, which has a static or stationary part in addition to the rotor part, is distinguished by the fact that the rotor part comprises a dimensional standard, and a plurality of transmitters is provided on the static part. Here, a dimensional standard is to be understood as an at least approximately one-dimensional pattern with a specific fine resolution on a path of length L. In other words, on the path of length L, each point can have a value assigned thereto between two extreme values, a minimum and a maximum value of a specific variable. Each transmitter is constructed so that when it physically approaches a specific point on the path L, it detects the value of the variable and processes it to form an output signal, which is a measure of the position of a position point P, for example the leading or trailing edge, of the dimensional standard. With the device according to the invention, the position coordinate X of the position point P of the dimensional standard, i.e., the position of the rotor part of the transport system, can be determined precisely down to the micrometer range. A number Gi of transmitters is distributed along the path, whether closed or open, which the rotor part takes. In other words, the transmitters are arranged along a position coordinate line; this coordinate line can either be straight or at least partly curved.

The distance between two successive transmitters along the coordinate line is advantageously constant and has a length A. It is advantageous to number off the transmitters along the coordinate line, by indexing being carried out from a first transmitter with a correspondingly suitable number, typically 1, and then, following the coordinate axis, each further transmitter having assigned thereto an index greater by 1. In other words, the transmitters ordered along the position coordinate line are, for example, indexed with successive natural numbers.

The distance A of two successive transmitters along the position coordinate line, i.e., if indexed, with an index differing only by 1, is preferably less than or equal to the length L of the dimensional standard. In a preferred embodiment, the dimensional standard is a magnetic pattern, and the transmitters are magnetic field detectors. In an alternative embodiment of the device according to the invention, the dimensional standard has a pattern which causes a variation in the intensity of the incident light, and the transmitters are optical detectors. In this connection, it is unimportant whether the dimensional standard is of straight or curved shape.

The position registering device is advantageously constructed so that at least one transmitter generates an output signal that is different from 0 which, at least on an interval of the position coordinate X in the vicinity of the position coordinate line around the transmitter, i.e., in the set of all position points around the transmitter which are at a distance less than or equal to a maximum predefined distance from the position point of the transmitter, is a monotonic function of the position point P of the dimensional standard.

The output signal from the transmitter, which is in a functional relationship with the position coordinate X of the dimensional standard, i.e., the position of the position point P of the dimensional standard on the position coordinate line, is particularly advantageously generated so that by detecting the pattern of the dimensional standard, for example, by measuring the periodic local dependence or change in the pattern as the dimensional standard passes along the position point of the transmitter, advantageously also as a function of the direction of movement, a monotonic increase or monotonic decrease takes place. By using the device according to the invention, therefore, given fine and precise configuration of the pattern, high local resolution or precision of the registration of the position of the rotor part can be achieved.

In order to compensate for mounting inaccuracies and to permit phase equalization between individual transmitters, an overlap, i.e., an interval on the position coordinate line, with a length U of the position coordinate X of the dimensional standard is provided, for which it is true that, if the position point P of the dimensional standard is in this interval, at least one first transmitter generates a first output signal and at least one second transmitter, which follows the first transmitter along the position coordinate line, generates a second output signal. It is therefore possible to achieve a transfer of the dimensional standard from a first transmitter to the next or second transmitter, i.e., calibration of the second output signal by the first output signal. A further advantage of the use of the device according to the invention is therefore making a transfer with high precision possible.

Other features which are considered as characteristic for the invention are set forth in the appended claims.

Although the invention is illustrated and described herein as embodied in a device for registering the position of a rotor part in a transport system, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings, wherein:

DESCRIPTION OF THE PREFERRED EMBODIMENTS

Figure 1:
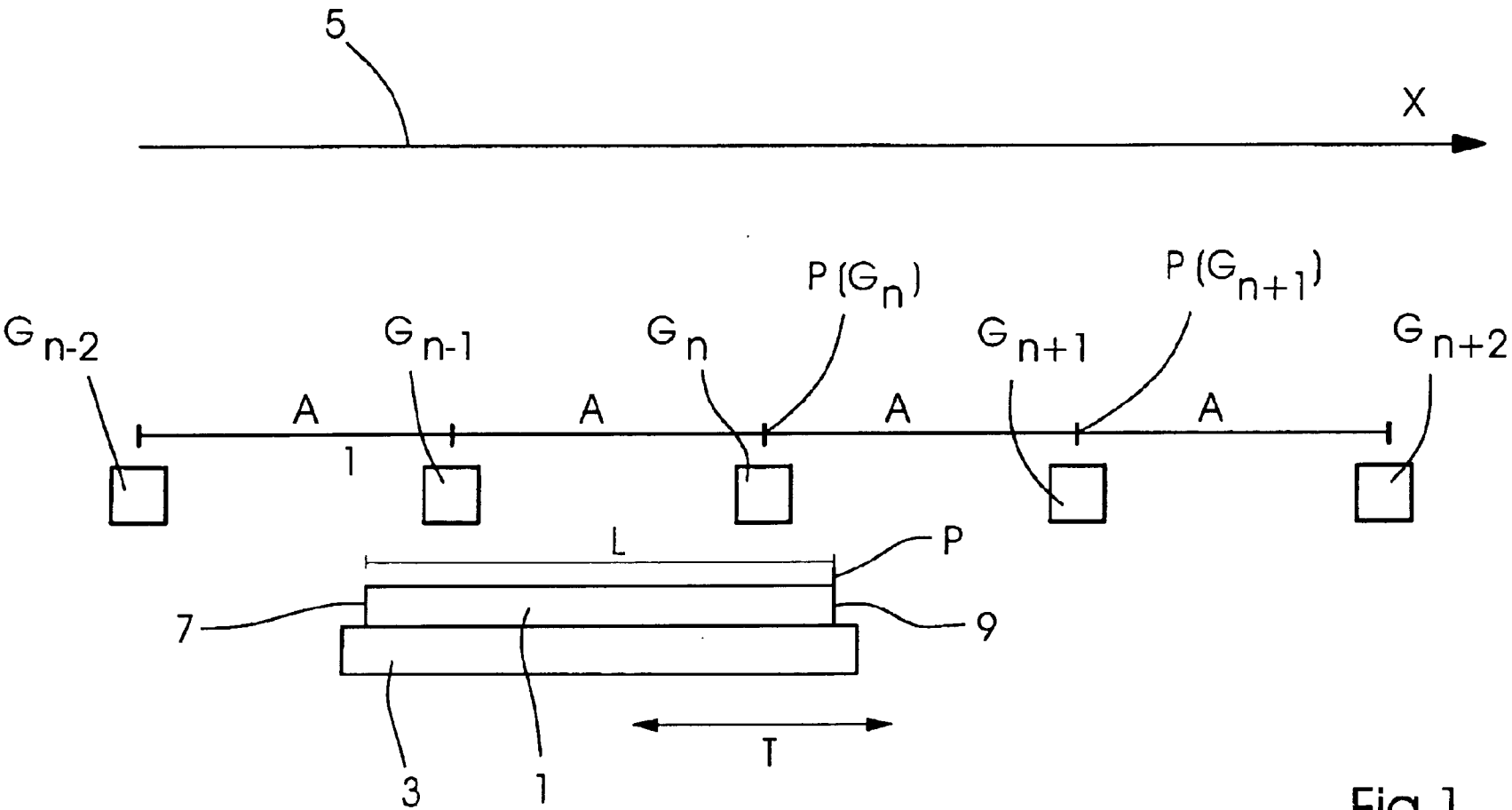
FIG. 1 is a schematic and diagrammatic representation of the topology of the device according to the invention for registering the position of a rotor part of a transport system.

Referring now to the drawings and, first, particularly to FIG. 1 thereof, there is shown therein, in a diagrammatic and schematic view, the topology of the device according to the invention for registering the position of a rotor part of a transport system, for example a linear drive. Shown therein is a dimensional standard 1, which is mounted on a rotor part 3. The rotor part 3 can move along a position coordinate line 5 in terms of a position coordinate X thereof or location. This direction of movement is represented by the double-headed arrow T. In machines which process printing material, only one direction of movement is often preferably provided. In order to simplify the schematic and diagrammatic representation of the device according to the invention, the position coordinate line 5 is shown drawn at a distance spaced from the device according to the invention.

In order to determine the position coordinate X of the rotor part 3, a position point P, for example the trailing edge 7 or the leading edge 9 of the dimensional standard 1, is selected. The dimensional standard has a length L. In a preferred embodiment, especially suitable for machines for processing printing material, the dimensional standard 1 is a virtually or at least approximately one-dimensional pattern of magnetic north and south poles, for example, a regular arrangement of alternating north and south poles. An embodiment of this type is particularly advantageously suitable for use in a machine that processes printing material, because of the insensitivity thereof to dirt.

Associated with the dimensional standard 1 and advantageously located opposite thereto is a plurality of transmitters G, for example, five transmitters G here, having the indices n−2, n−1, n, n+1, n+2. This notation of the indices is intended to illustrate that there is a row of transmitters along the position coordinate line 5, which are numbered off from a first transmitter to a transmitter with the maximum index. Shown here is the nth transmitter Gn with the transmitters respectively adjacent thereto, namely the preceding transmitters $G_{n-1}$ and $G_{n-2}$ and the following transmitters $G_{n+1}$ and $G_{n+2}$, wherein n designates a natural number. An appropriate continuation of the row of transmitters in the direction of increasing indices and in the direction of decreasing indices is anticipated. All of the transmitters which follow one another along the position coordinate line 5 advantageously have an at least approximately uniform spacing A. However, it is also conceivable to arrange the plurality of transmitters with generally different spacings, respectively, between successive transmitters.

The transmitters are constructed for detecting the magnetic pattern on the dimensional standard 1 and to use the pattern for generating an output signal which is a measure of the position coordinate X of the position point P of the dimensional standard 1, i.e., the rotor part 3. In this case, the transmitters detect the magnetic field of a position point P(G) associated therewith, typically the center of gravity of the detector area of the point on the dimensional standard 1 lying opposite the corresponding transmitter.

Figure 2:
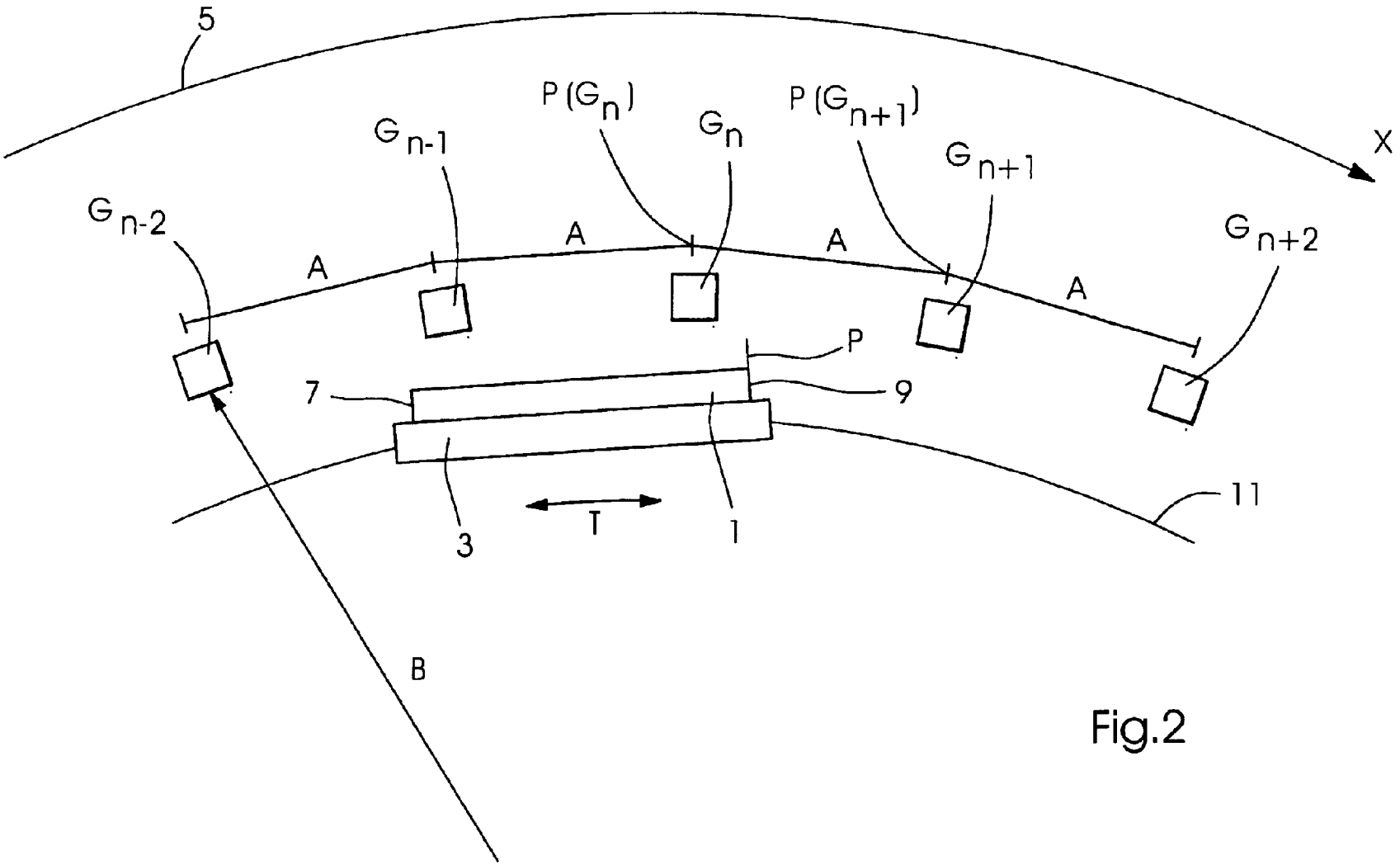
FIG. 2 is a view similar to that of FIG. 1 of the topology of the device according to the invention, which has a rotor part moving on a curved path.

FIG. 2 is a schematic and diagrammatic representation of the topology of the device according to the invention for registering the position of a rotor part that moves on a curved path 11. To simplify the schematic and diagrammatic representation of the device according to the invention, a position coordinate line 5 is shown spaced a distance from the device according to the invention. The dimensional standard 1 is provided on the rotor part 3, and the position of a position point P, for example, the trailing edge 7 or the leading edge 9 of the dimensional standard 1 is to be detected on the position axis 5. The rotor part 3 moves along a curved path 11, for example, along a circular segment. The transmitters arranged opposite the dimensional standard 1, along the position coordinate line 5, here five transmitters, for example, with the indices n−2, n−1, n, n+1, n+2, meeting the same nomenclature rules as the transmitters G in FIG. 1, are located on an arcuate segment with a curvature radius B, and have an at least approximately uniform mutual spacing A. Appropriate continuation of the row of transmitters in the direction of rising indices and in the direction of falling indices is visualized.

In an advantageous development of the invention, at least one reference pulse transmitter and/or an absolute transmitter is provided. If absolute position-control linear drives are used, the absolute position of the rotor part must be determined at least once at the start of operation. This is normally done by an absolute track or by a reference pulse. Reference pulse transmitters and/or absolute transmitters can therefore advantageously be installed at defined intervals over the entire length of the path of the rotor part, opposite the dimensional standard, and encoded absolutely. When the linear drive is started, it is then necessary for a specific distance to be covered under controlled operation, until a reference pulse is detected as an output signal from a reference pulse transmitter. This distance corresponds at most to the spacing from one reference pulse transmitter to a further, next reference pulse transmitter.

Figure 3:
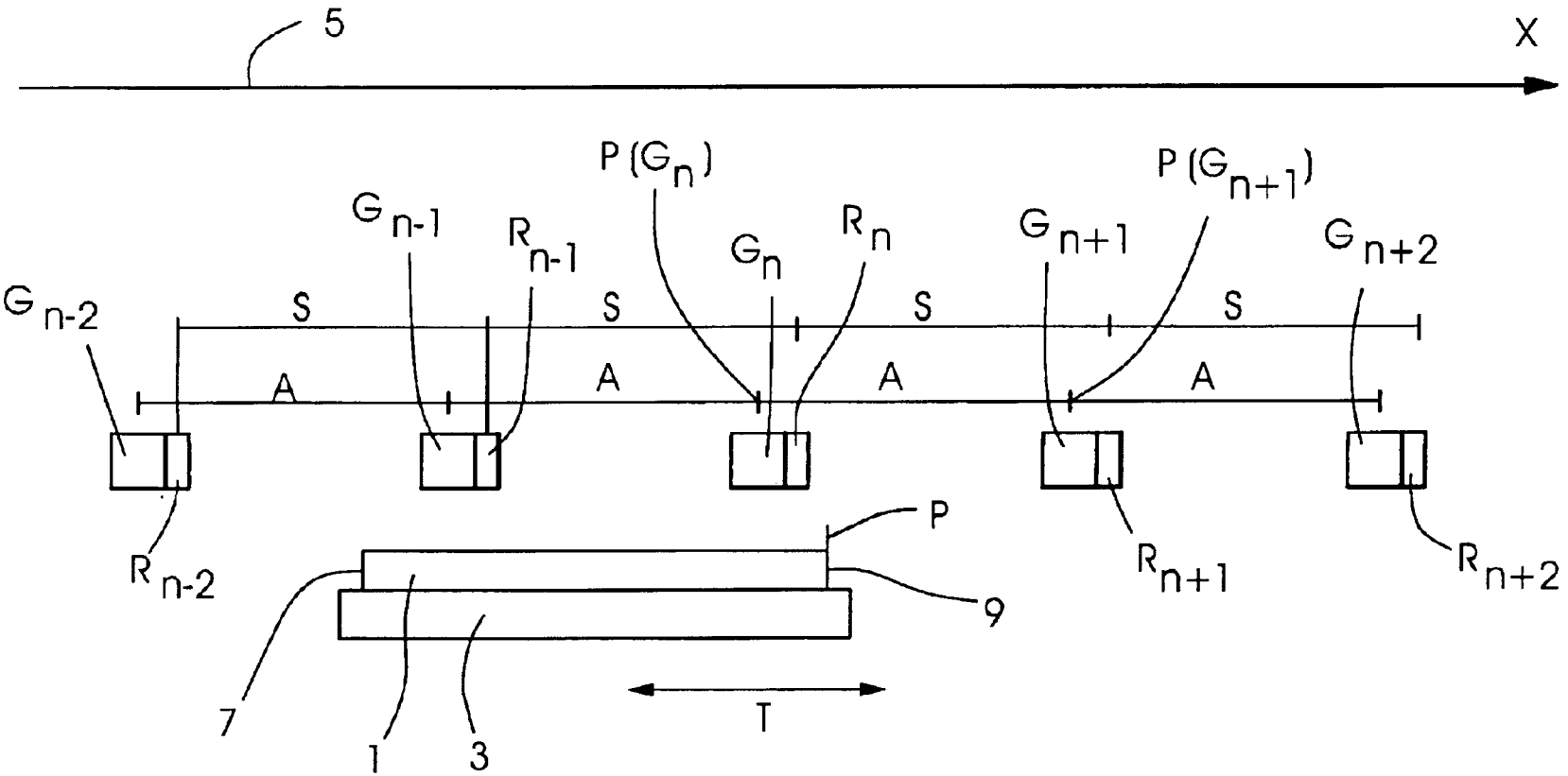
FIG. 3 is a view similar to that of FIG. 1, of a different embodiment of the device according to the invention having reference pulse transmitters.

FIG. 3 shows in a schematic and diagrammatic view an advantageous development of the device according to the invention, which has reference pulse transmitters. FIG. 3 represents a dimensional standard 1 which is provided or mounted on a rotor part 3. To simplify the schematic and diagrammatic representation of the advantageous development, a position coordinate line 5 is shown at a spaced distance from the device according to the invention. The position coordinate X of a position point P, for example, the trailing edge 7 or the leading edge 9 of the dimensional standard 1, along the position coordinate line 5 is detected by a number of transmitters G, here five transmitters, for example, with the indices n−2, n−1, n, n+1, n+2, which are arranged along the position coordinate line 5, successive transmitters having a uniform mutual spacing A. Associated with each transmitter and advantageously integrated into the transmitters is a reference pulse transmitter R, shown here by way of example as five reference pulse transmitters R with the indices n−2, n−1, n, n+1, n+2, which have an at least approximately equal mutual spacing S, the spacing S between the reference pulse transmitters R in the embodiment shown being equal to the spacing A of the transmitters G. An appropriate continuation of the rows of transmitters and reference pulse transmitters in the direction of increasing indices and in the direction of decreasing indices along the position coordinate line 5 is contemplated.

Figure 4:
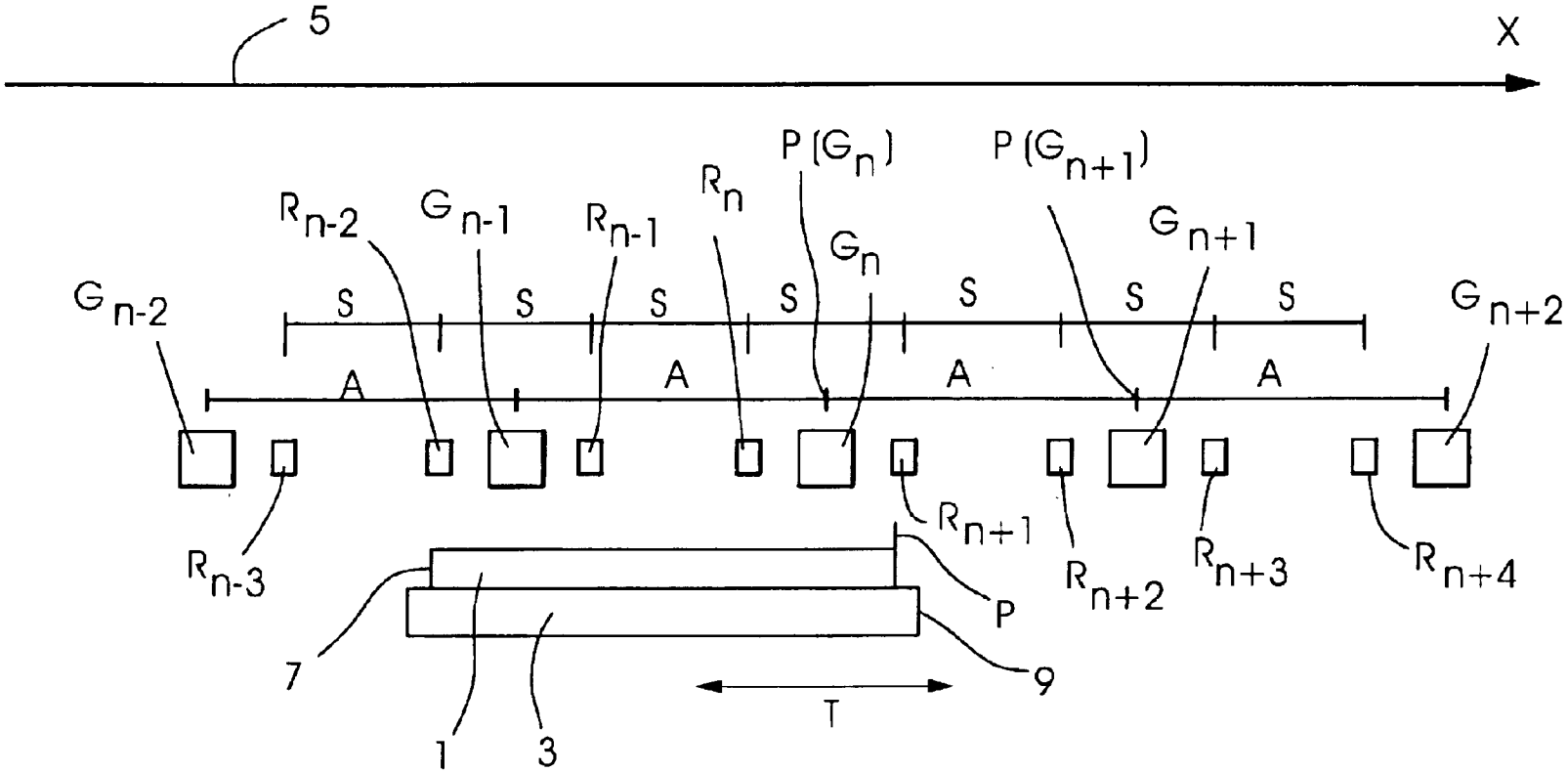
FIG. 4 is a view similar to that of FIG. 3 and showing an alternative embodiment of the device according to the invention having reference pulse transmitters.

FIG. 4 represents schematically and diagrammatically an alternative embodiment of the development of the device according to the invention, with reference pulse transmitters. Shown therein is a dimensional standard 1 provided on a rotor part 3, which can move along the position coordinate line 5 in the direction of movement indicated by the double-headed arrow T. To simplify the schematic and diagrammatic representation of the alternative embodiment, the position coordinate line 5 is shown spaced a distance from the device according to the invention. The position coordinate X or location of a position point P, for example, the trailing edge 7 or the leading edge 9 of the dimensional standard 1, is determined by a plurality of transmitters G, five transmitters here, for example, with the indices n−2, n−1, n, n+1, n+2, successive transmitters along the position coordinate line 5 having a uniform mutual spacing A. Reference pulse transmitters R are provided, which are arranged along the position coordinate line 5, successive reference pulse transmitters R having a uniform mutual spacing S, eight reference pulse transmitters being shown here, for example, with the indices n−3, n−2, n−1, n, n+1, n+2, n+3, n+4. An appropriate continuation of the rows of transmitters and of reference pulse transmitters in the direction of increasing indices and in the direction of decreasing indices along the position coordinate line 5 is contemplated.

A reference pulse, as an output signal from a reference pulse transmitter R, indicates the exact absolute position, for example, of the leading edge of the dimensional standard 1, and therefore of the rotor part 3. Starting from this known absolute position value, the position coordinate X of the position point P can then be determined by using the transmitters G, the output signal is incremental, i.e., rises or falls monotonically.

Figure 5:
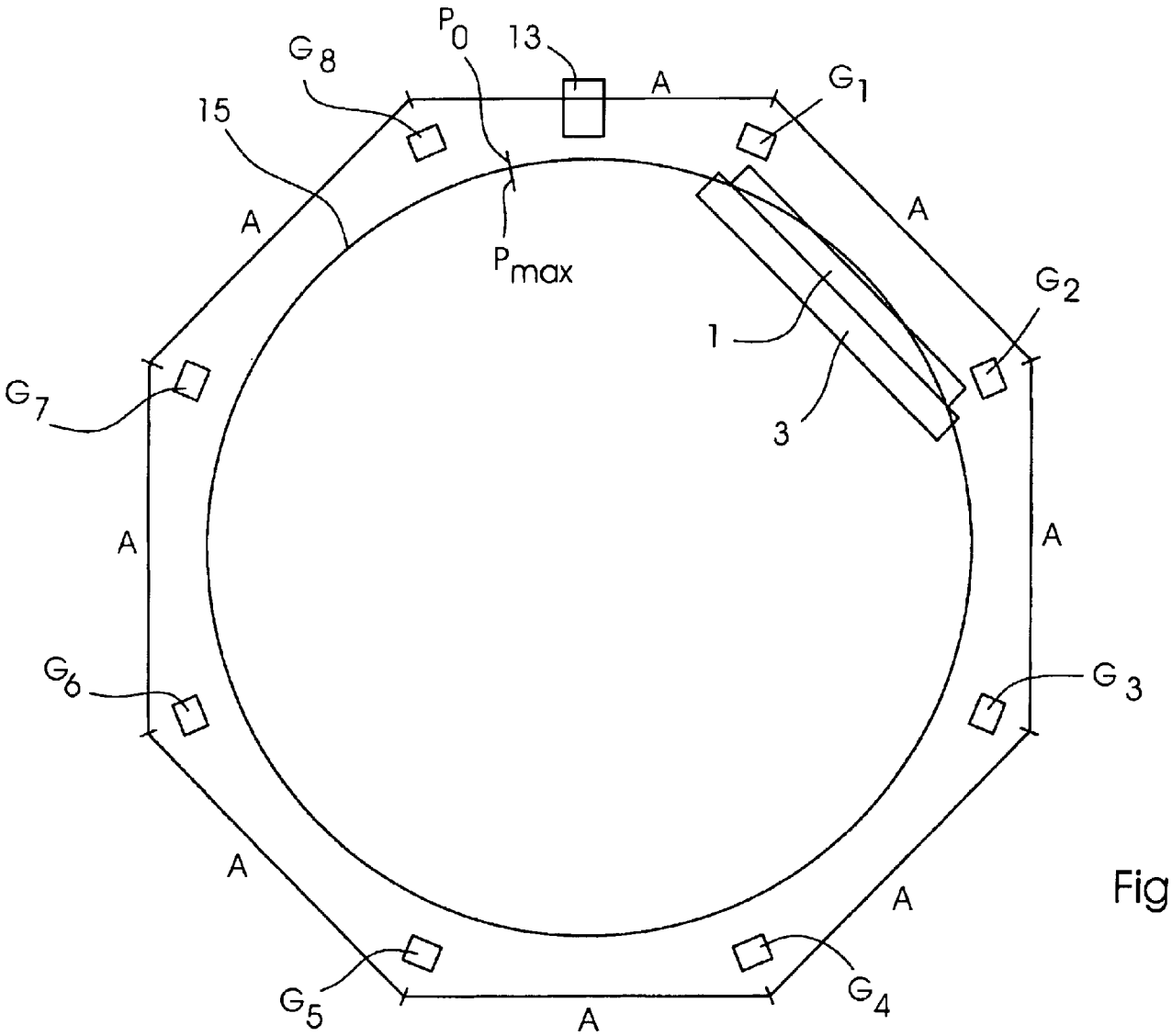
FIG. 5 is a view of a further embodiment of the device according to the invention having with a closed path for the rotor part.

FIG. 5 is a schematic and diagrammatic representation of a configuration of an embodiment of the device according to the invention which comprises a closed path 15 including the position coordinate axis here, for example, of the rotor part 3. By using a reference pulse transmitter 13 in addition to the incremental transmitters G, eight transmitters $G_1$, $G_2$, $G_3$, $G_4$, $G_5$, $G_6$, $G_7$, and $G_8$ here, for example, the controlled operation after switching on and before the detection of a first reference pulse as an output signal from the reference pulse transmitter 13 can be circumvented. The reference pulse transmitter 13 reads out the absolute position once and initializes the control of the linear drive with this value.

Via the control system, the correct phase currents for the forward drive device (not shown here) of the linear drive is impressed, so that the rotor part 3, which carries a dimensional standard 1, is started up. At least once per pass on the closed path 11, the position of the rotor part 3 can be determined by an output signal being triggered in the reference pulse transmitter at one location per pass. A corresponding method can be used for a large number of rotor parts 3.

In a configuration of the device according to the invention as shown in FIG. 5, a first position point $P_0$ of the position coordinate X of the dimensional standard 1 coincides with a maximum position point $P_{max}$ of the position coordinate X of the dimensional standard 1. A closed position coordinate line is involved here. This condition is a sufficient criterion to call for a closed path for the rotor part 3. In such a topology of the path, the invention advantageously provides for both in each case two successive transmitters along the position coordinate line with an index differing by only 1, and the transmitter with a minimum index, the transmitter G1 in FIG. 5, for example, and the transmitter with the maximum index, the transmitter G8 in FIG. 5, for example, to have at least approximately the same mutual spacing A. In an advantageous development of the device according to the invention, in a topology with a closed path, a plurality of reference transmitters arranged along the position coordinate line are provided, for which it is true that both in each case two successive reference transmitters, i.e., with an index differing by only 1, and the reference transmitter with the minimum index and the reference transmitter with the maximum index have at least approximately like mutual spacing S. However, it is also conceivable to provide a generally different spacing S between two successive reference transmitters. In a topology with a closed path 15, provision is therefore advantageously made for successive transmitters G to have at least approximately the same mutual spacing and/or for successive reference transmitters R to have at least approximately the same mutual spacing S. In addition, one or more absolute transmitters can be provided.

Figure 6:
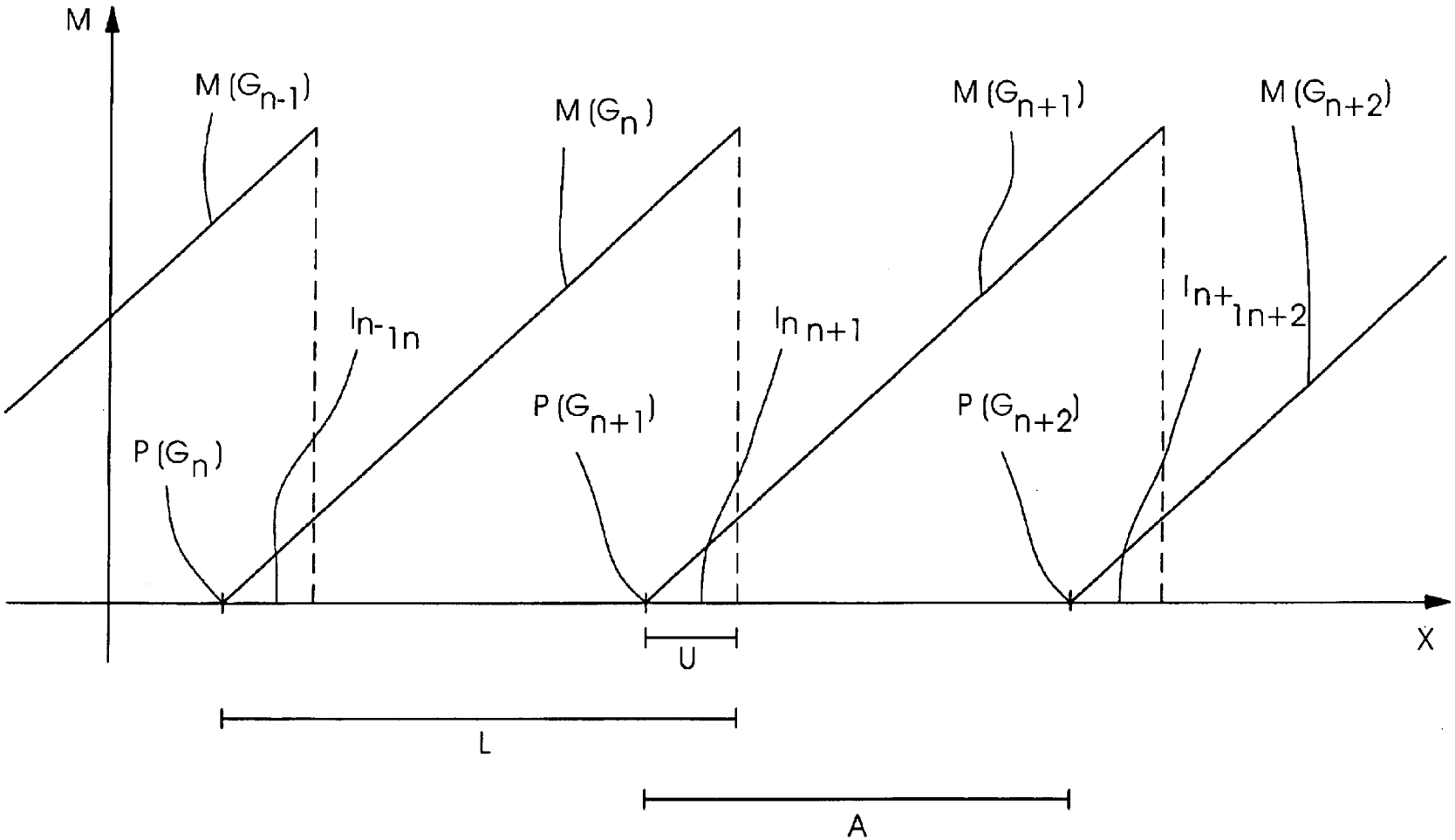
FIG. 6 is a plot diagram of the functional relationships of output signals $M(G_i)$ of transmitters Gi, an index i counting transmitters, as a function of a position X of a position point P of a dimensional standard.

FIG. 6 is a schematic representation of the functional relationships between the output signals $M(G_i)$ of the transmitters Gi, the index i counting the transmitters, as a function of the position coordinates X of the position point P of the dimensional standard 1. The figure shows monotonic, here, for example, uniformly increasing output signals from four transmitters $G_{n-1}$, $G_n$, $G_{n+1}$ and $G_{n+2}$. The fact that the spacing A between two transmitters having an index differing by only 1 is less than the length L of the dimensional standard 1 means that intervals I between position values are produced, for which it is true that, if the position point P of the dimensional standard 1 is located in one of these intervals, at least one first transmitter generates a first output signal, and at least one second transmitter, which has an index differing from the index of the first transmitter by only 1, generates a second output signal. In other words, the output signals from two successive transmitters along the position coordinate line, the index of which differs by only 1, overlap on an interval I of position values or position coordinates X. Shown here, by way of example, are the three intervals $I_{n+1n}$, $I_{n(n+1)}$ and $I_{(n+1)(n+2)}$. An appropriate continuation of the row of intervals in the direction of increasing indices and in the direction of decreasing indices applies appropriately. For the ith interval $I_{i(i+1)}$, it is true that one interval limit is given by the position point of the ith transmitter $G_i$, and the second interval limit is given by a point at a distance U from the position point of the transmitter Gi, U being the difference between the length L of the dimensional standard 1 and the spacing A between two successive transmitters along the position coordinate line having an index differing by only 1. In other words, there exists an environment around the position point of the transmitter $G_i$ wherein the interval $I_{i(i+1)}$ is located but not the position point $P(G_{i+1})$ of the transmitter $G_{i+1}$, and there exists an environment around the transmitter $G_{i+1}$ wherein the interval $I_{i(i+1)}$ is located but not the position point $P(G_i)$ of the transmitter $G_i$.

A device of this type according to the invention for registering the position of a rotor part in a transport system can advantageously be used in particular in machines which process printing material. In a printing unit, the transport of the printing material can be performed, at least in part, by a transport system, for example a linear drive, which has a device according to the invention for registering the position of a rotor part of the transport system. A printing machine according to the invention has at least one printing unit of this type according to the invention. A printing machine having a feeder, at least one printing unit, a delivery or a post-processing unit, according to the invention has at least one transport system with a device according to the invention for registering the position in order to transport the printing material between the printing unit and a further printing unit, between the feeder and the printing unit, between the printing unit and the delivery or between the printing unit and the post-processing unit.

We claim:

1. A device for registering the position of a rotor part in a transport system also having a static part in addition to the rotor part, comprising a dimensional standard having a length and including a position point, said dimensional standard having a pattern with a specific fine resolution and forming part of the rotor part, and a plurality of transmitters each having a respective position point and being provided on the static part disposed along a position coordinate line of a position coordinate, said plurality of transmitters detecting said pattern of said dimensional standard, and defining a spacing between two successive transmitters along said position coordinate line being at most equal to said length of said dimensional standard.

2. The position registering device according to claim 1, wherein respective pairs of said plurality of transmitters arranged successively along said position coordinate line have at least approximately the same mutual spacing.

3. The position registering device according to claim 1, wherein said transmitters are magnetic field detectors, and said dimensional standard has a magnetic pattern.

4. The position registering device according to claim 1, wherein said transmitters are optical detectors, and said dimensional standard has a pattern for causing a variation in intensity of incident light.

5. The position registering device according to claim 1, wherein at least one of said transmitters serves for generating an output signal, which, at least on an interval of said position coordinate, in an environment around said one transmitter, is a monotonic function of said position point of said dimensional standard.

6. The position registering device according to claim 5, wherein said interval has a given length of said position coordinate of said dimensional standard for which, when said position point of said dimensional standard is in said interval, at least a first one of said transmitters serves for generating a first output signal, and at least a second one of said transmitters, which follows said first transmitter, serves for generating a second output signal.

7. The position registering device according to claim 6, wherein said first transmitter is surrounded by an environment wherein said interval is located and from which said position point of said second transmitter is absent, and said second transmitter is surrounded by an environment wherein said first interval is located and from which said position point of said first transmitter is absent.

8. The position registering device according to claim 1, including a transmitter selected from the group thereof consisting of at least one reference pulse transmitter and at least one absolute transmitter.

9. The position registering device according to claim 8, wherein, respectively, two reference pulse transmitters arranged along said position coordinate line have at least approximately the same mutual spacing.

10. The position registering device according to claim 9, wherein said spacing between two successive reference pulse transmitters, respectively, along said position coordinate line is at most equal to the spacing between two successive transmitters.

11. The position registering device according to claim 1, wherein a first position point of said position coordinate of said dimensional standard coincides with a second position point of said position coordinate of said dimensional standard.

12. The position registering device according to claim 11, wherein two successive transmitters, respectively, a transmitter with a minimum index and a transmitter with a maximum index have at least approximately the same mutual spacing.

13. The position registering device according to claim 11, wherein two successive reference transmitters, respectively, a reference transmitter with a minimum index and a reference transmitter with a maximum index have at least approximately the same mutual spacing.

14. A printing unit having a device for registering the position of a rotor part in a transport system also having a static part in addition to the rotor part, comprising a dimensional standard having a length, a pattern with a specific fine resolution, and forming part of the rotor part, and a plurality of transmitters provided on the static part disposed along a position coordinate line of a position coordinate, said plurality of transmitters detecting said pattern of said dimensional standard, and defining a spacing between two successive transmitters along said position coordinate line being at most equal to said length of said dimensional standard.

15. A printing machine including a printing unit having a device for registering the position of a rotor part in a transport system which also has a static part in addition to the rotor part, comprising a dimensional standard having a length, a pattern with a specific fine resolution, and forming part of the rotor part, and a plurality of transmitters provided on the static part disposed along a position coordinate line of a position coordinate, said plurality of transmitters detecting said pattern of said dimensional standard, and defining a spacing between two successive transmitters along said position coordinate line being at most equal to said length of said dimensional standard.

16. A printing machine comprising a feeder, at least one printing unit, a unit selected from the group consisting of a delivery unit and a post-processing unit, and at least one transport system having a device for registering the position of a rotor part in said transport system, said transport system also having a static part in addition to said rotor part, and including a dimensional standard having a length, a pattern with a specific fine resolution, and forming part of the rotor part, and a plurality of transmitters provided on the static part disposed along a position coordinate line of a position coordinate, said plurality of transmitters detecting said pattern of said dimensional standard, and defining a spacing between two successive transmitters along said position coordinate line being at most equal to said length of said dimensional standard.

* * * * *